US006408800B2

(12) United States Patent
Schmidt et al.

(10) Patent No.: US 6,408,800 B2
(45) Date of Patent: Jun. 25, 2002

(54) SEPARATOR FOR A WATER/STEAM SEPARATING APPARATUS

(75) Inventors: Holger Schmidt; Eberhard Wittchow, both of Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/789,794

(22) Filed: Feb. 20, 2001

Related U.S. Application Data

(63) Continuation of application No. PCT/DE99/02434, filed on Aug. 5, 1999.

(30) Foreign Application Priority Data

Aug. 17, 1998 (DE) ..... 198 37 250

(51) Int. Cl.[7] ..... F16T 1/00
(52) U.S. Cl. ..... 122/488; 122/491
(58) Field of Search ..... 122/1 B, 406.4, 122/488, 489, 491

(56) References Cited

U.S. PATENT DOCUMENTS 3,992,172 A * 11/1976 Clark ..... 122/488
5,983,842 A * 11/1999 Nishi ..... 122/491

* cited by examiner

*Primary Examiner*—Gregory Wilson
(74) *Attorney, Agent, or Firm*—Laurence A. Greenberg; Werner H. Stemer; Gregory L. Mayback

(57) ABSTRACT

A separator separates water and steam. The separator has a steam-side outlet conduit, a water-side outlet conduit, and a separating chamber between a number of inlet conduits. A swirl breaker is upstream of the water-side outlet conduit. To achieve the lowest possible pressure loss with a simultaneously high medium throughput and an effective separating action, the length of the separating chamber is at least 5 times the internal diameter (DI) of the chamber. Furthermore, the ratio of the overall flow cross section of the inlet conduits to the square of the internal diameter of the separating chamber is between 0.2 and 0.3. Within a water/steam separating apparatus, the separator is connected to a water-collecting tank such that the top end of the latter is located beneath halfway along the length of the separator—calculated from the water-side, bottom end of the same.

7 Claims, 2 Drawing Sheets

Figure 2:
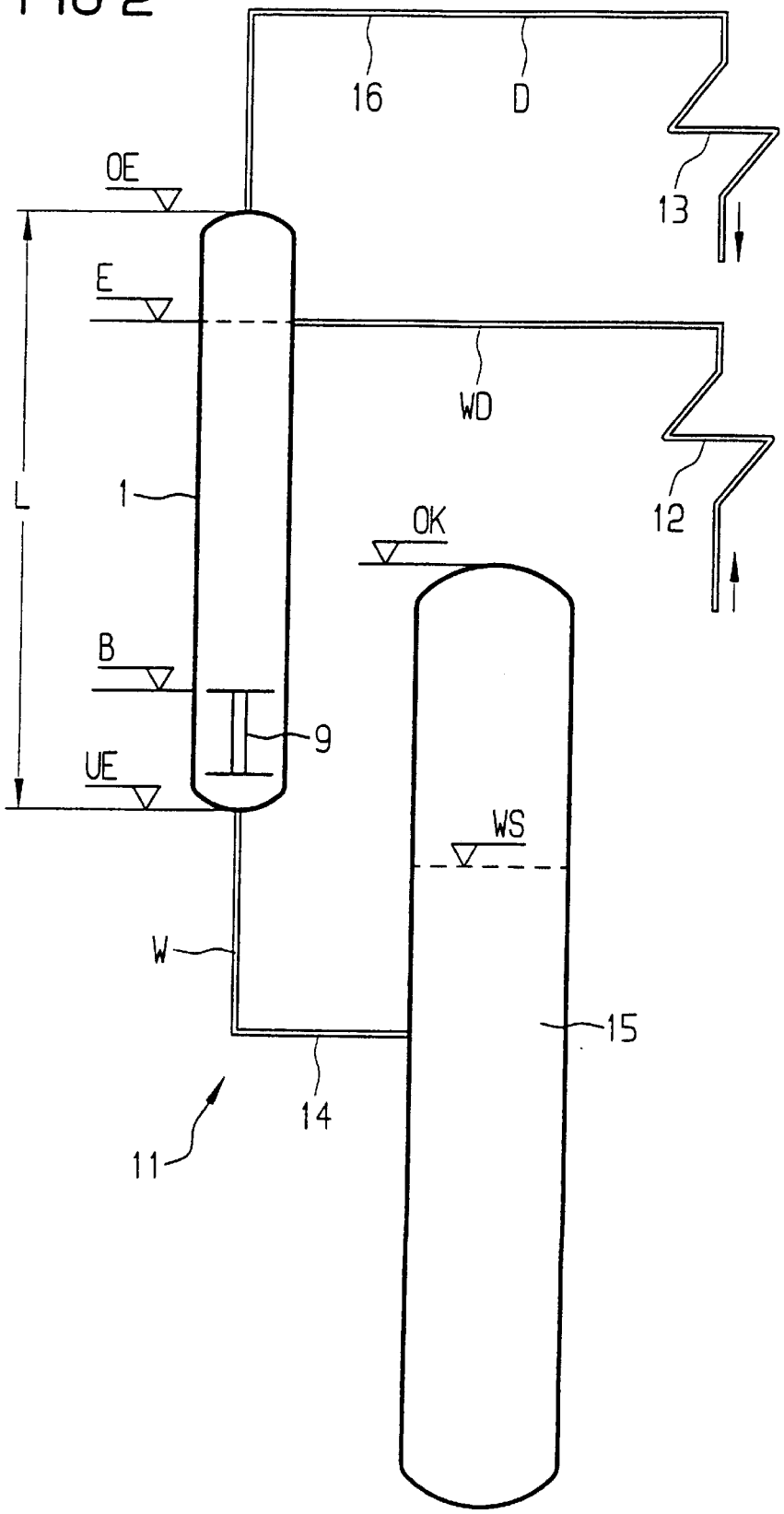

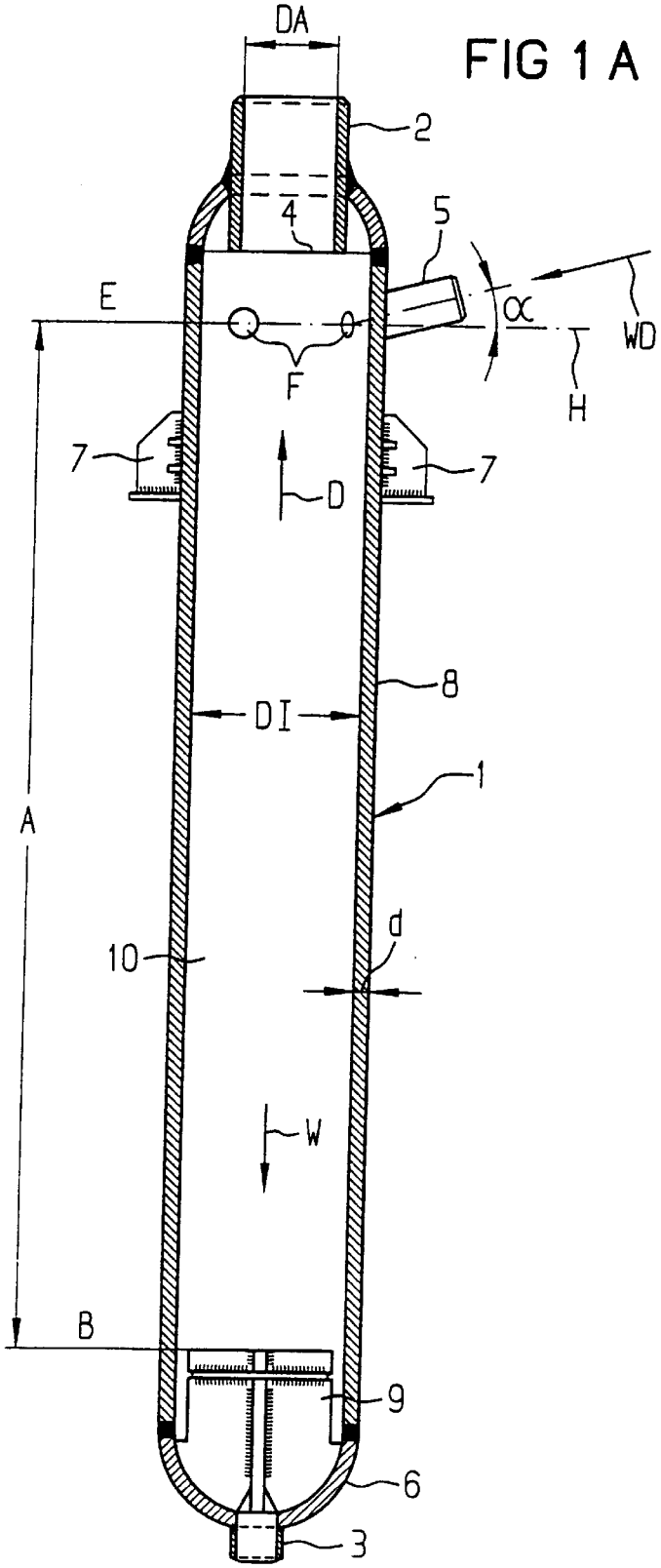
FIG 1 A
FIG 1 B
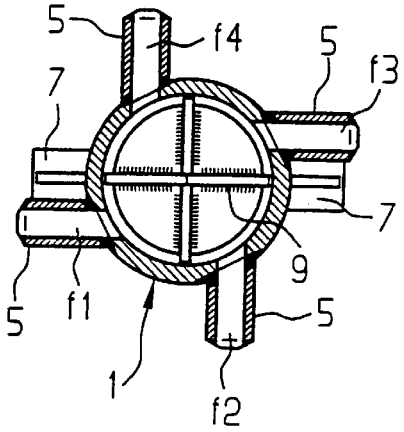

SEPARATOR FOR A WATER/STEAM SEPARATING APPARATUS

CROSS-REFERENCE TO RELATED APPLICATION

This application is a continuation of copending International Application No. PCT/DE99/02434, filed Aug. 5, 1999, which designated the United States.

BACKGROUND OF THE INVENTION

Field of the Invention

The invention relates to a separator for separating water and steam, having a steam-side outlet conduit and having a water-side outlet conduit and having a separating chamber between a number of inlet conduits and a swirl breaker disposed upstream of the water-side outlet conduit. The invention also relates to a water/steam separating apparatus, in particular for a continuous-flow steam generator, having at least one such separator that is connected to a water-collecting tank.

German Published, Prosecuted Patent Application 1 081 474 discloses a centrifugal-force water separator in which the ratio of diameter to height is intended to be approximately one to six or more (>1:6). Furthermore, the article by Jürgen Vollrath, entitled "Dampfabscheidung bei Siedewasser und Siedeüberhitzerreaktoren, [Steam separation in boiling-water and boiling/superheating reactors]," in *Technische Überwachung* 9 (1968), No. 2, pp. 46–50, teaches to select a ratio of the diameter of a steam-side outlet conduit of a separator to the internal diameter of the separator of fifty-two percent (52%). In addition, JP 1-31 23 04 A discloses a water/steam separating apparatus in which a water-collecting tank is disposed at a vertical height which is determined by the vertical height of the separator. This water-collecting tank is connected to the separator on the water side. A separator of the generic type is known, for example, from GB-A-1164996.

A separator known from, German Published, Non-Prosecuted Patent Application DE 42 42 144 A1, which is owned by the assignee of the instant application is usually used in the evaporating system of a steam generator, in particular of a continuous-flow steam generator. Depending on the steam-generator capacity, usually a plurality of separators disposed in parallel are connected, within a water/steam separating apparatus, to a common water-collecting tank. In particular, during start-up operation of such a continuous-flow steam generator, large quantities of water are generally produced in the evaporating system. Each separator serves here for separating water and steam, the water being guided back into the evaporator circuit and steam, as far as possible free of water droplets, being directed into a superheater.

Because, in contrast to a natural-circulation steam generator, a continuous-flow steam generator is not subjected to any pressure limitation, and live-steam pressures high above the critical pressure of water ($P_{crit}$=221 bar) are thus possible, modern steam power plants can be operated with high steam pressures of 250 to 300 bar. High live-steam pressures are necessary in order to achieve high thermal efficiencies and thus low carbon-dioxide emissions. A particular problem here is the configuration of the pressure-carrying parts because such high steam pressures require large wall thicknesses, which, in turn, can reduce considerably the heat transfer.

In a continuous-flow steam generator, the separators are particularly affected by reduced heat transfer. Because, in the case of load changes in variable-pressure operation, in which the steam pressure and thus also the boiling temperature in each separator changes linearly with the load, the separators are subjected to considerable changes in temperature. As a result, during start-up and in the case of load changes, the reliable temperature-change speed is significantly limited. This, in turn, may produce undesirably long start-up times with correspondingly high start-up losses and a low load-change speed, which, in turn, restricts the particularly high flexibility of the continuous-flow steam generator at least during operation with high steam pressures.

SUMMARY OF THE INVENTION

It is accordingly an object of the invention to provide a separator for a water/steam separating apparatus that overcomes the hereinafore-mentioned disadvantages of the heretofore-known devices of this general type and which, with simultaneously low pressure loss and a high degree of separation as well as the smallest possible wall thickness, is particularly thermoelastic.

With the foregoing and other objects in view, there is provided, in accordance with the invention, a separator for separating water and steam. The separator includes a number of inlet conduits each having a flow cross section defining an overall flow cross section equaling a sum of said flow cross sections. A separating chamber between the inlet conduits has a length, a separating chamber inner diameter, and a ratio. The ratio equals a ratio of the overall flow cross section to a square of said separating chamber internal diameter. The length is at least five times the separating chamber internal diameter. The ratio is between 0.2 and 0.3. A steam-side outlet conduit is connected to the separating chamber. A water-side outlet conduit is connected to the separating chamber. A swirl breaker is disposed upstream of the water-side outlet conduit.

In accordance with another feature of the invention, the steam-side outlet conduit has a steam-side outlet conduit internal diameter equaling 40% to 60% of the separating channel internal diameter.

With the objects of the invention in view, there is also provided a water/steam separating apparatus including a separator as described above for separating water and steam and a water-collecting tank. The water-collecting tank is connected to the water-side outlet conduit of the separator. The water-collecting tank has a top end located beneath said midpoint of the length of the separator.

In accordance with another feature of the invention, the steam-side outlet conduit has a steam-side outlet conduit internal diameter equaling 40% to 60% of the separating channel internal diameter.

With the objects of the invention in view, there is also provided a method of operating a water/steam separating apparatus. The method includes providing a separator for separating water and steam. The next step is setting a throughput M through the separator at least equaling six hundred thirty times a square of the internal diameter.

In accordance with another mode of the invention, the method includes operating a continuous-flow steam generator including the separator at a maximum flow load.

In accordance with another feature of the invention, the method includes sizing a steam-side outlet conduit internal diameter of the steam-side outlet conduit between 40% and 60% of the separating channel internal diameter.

A further object of the invention is to specify a suitable method of operating a water/steam separating apparatus for a continuous-flow steam generator having a number of such separators.

Regarding the separator, the object is achieved by lengthening the separating chamber of the separator to at least five times (5×) the internal diameter of the chamber. In this case, the length of the separating chamber is defined by the distance between the inlet plane, which is determined by the inlet conduits of the separator, and the top edge of the swirl breaker located therebeneath. The ratio of the overall flow cross section of the inlet conduits to the square of the internal diameter of the separating chamber is between two tenths and three tenths (0.2–0.3).

The invention is based here on the finding that, surprisingly, in the case of a separator, in particular in the case of a cyclone separator, having a swirl breaker, the pressure loss in the separating chamber is comparatively high, whereas pressure losses caused by the steam-side outlet conduit are low. While this behavior is not represented in the literature, it was possible to confirm it mathematically. In the case of a cyclone separator without a swirl breaker, the considerable pressure losses occur at the inlet into the steam-side outlet conduit and in the outlet conduit itself. And, only minimal pressure losses occur in the separating chamber.

From this discovery, the invention applies the following property. By virtue of the specific configuration of the separator, the pressure-loss components in different sections of the separator can be coordinated with one another. Coordinating and setting a high medium throughput and an effective separating action minimize the sum of the pressure-loss components. In this case, the pressure loss includes an inlet pressure-loss component, a frictional pressure-loss component, and a deflection pressure-loss component. The frictional pressure-loss component occurs during the downward and upward flow of the water/steam mixture entering into the separator. The deflection pressure-loss component occurs during the downward flow into the upward flow and of the inlet pressure-loss component into the steam-side outlet conduit.

During the operation of the separator, even in the case of a high mass flow density of $M>800\ kg/m^2s$ of the medium entering into said separator, a particularly low pressure loss with a simultaneously good separating action is achieved. The mass flow density is defined here as the throughput in kilograms per second [kg/s] divided by the cross-sectional surface area in square meters [$m^2$] determined by the internal diameter in meters [m] of the separator and thus of the separating chamber of the same.

Furthermore, the lowest possible pressure loss with the simultaneously highest possible degree of separation is achieved in that the overall cross-sectional surface area F [$m^2$], determined by the sum of the cross-sectional surface areas or flow cross sections of the inlet conduits, and the internal diameter DI [m] of the separator or of the separating chamber of the same satisfy the relationship $F=K\cdot DI^2$, where K=0.2 to 0.3, preferably K=0.21 to 0.26. In this case, the internal diameter DA [m] of the steam-side outlet conduit is preferably forty percent to sixty percent (40% to 60%) of the internal diameter of the separator.

With respect to the configuration of a number of such separators within a water/steam separating apparatus, in which, for example, three or four separators are connected to the common water-collecting tank on the water side, this particularly low pressure loss with a simultaneously high degree of separation is also advantageously assisted, even with a high mass flow density of the medium of more than 800 $kg/m^2s$, in that the top end of the water-collecting tank does not project beyond half of the axial extent of the separator. In relation to the water-side, bottom end of the separator, the top end or the top edge of the water-collecting tank should be located in this case beneath halfway along (the midpoint of) the length of the separator.

Regarding the method, particularly advantageous results are achieved in the case of a continuous-flow steam generator having at least one separator by setting the throughput through the separator at full load of the continuous-flow steam generator to more than 630 times the square of the internal diameter of the separating chamber.

Other features that are considered as characteristic for the invention are set forth in the appended claims.

Although the invention is illustrated and described herein as embodied in a separator for a water/steam separating apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

FIG. 1*a* is front cross-sectional view of a separator having a swirl breaker;

FIG. 1*b* is a top cross-sectional view of the separator shown in FIG. 1; and FIG. 2 is a schematic view of a water/steam separating apparatus having a separator according to FIG. 1, with a water-collecting tank connected on the water side.

DESCRIPTION OF THE PREFERRED EMBODIMENTS

In all the figures of the drawing, sub-features and integral parts that correspond to one another bear the same reference symbol in each case.

Referring now to the figures of the drawings in detail and first, particularly to FIG. 1*a* thereof, there is shown a separator or cyclone separator 1 in longitudinal section. The cross section is illustrated in FIG. 1*b*. The separator 1 has a top, steam-side outlet conduit 2 and a bottom, water-side outlet conduit 3. Inlet conduits 5 are distributed on the circumference of the separator 1 and are intended for a water/steam mixture WD that is to be separated into water W and steam D. The inlet conduits 5 are provided beneath the steam-side outlet conduit 2, in an inflow or inlet plane E, which is located in the vicinity of the inlet opening 4 of said outlet conduit. In this case, the inlet conduits 5, on the one hand, are inclined at an angle $\alpha$ to the horizontal H and, on the other hand, are disposed tangentially. Beneath the inlet plane E of the inlet conduits 5, supporting brackets 7 are provided on the wall 8 of the separator 1 and retain the latter in its installation position.

By virtue of this configuration of the inlet conduits 5, the water/steam mixture WD flowing into the separator 1, on the one hand, is guided downward in the direction of the base region 6 of the separator 1 and, on the other hand, is provided with a swirl in the process. Water W and steam D are separated here by centrifugal force. The steam D is guided away upward. The water is guided away downward, centrally. In order to break the swirl in the water W flowing out via the outlet conduit 3, a swirl breaker 9 is provided in the base region 6 of the separator 1. The swirl breaker 9 prevents steam D from being entrained into the outlet conduit 3 and forms an obstacle to already separated water W being fed back into the separator 1, i.e. to a backflow into the separating chamber 10 of the same.

In order to minimize the wall thickness d of the wall 8 of the separator 1 with a simultaneously high degree of separation, the length A of the separating chamber 10 of the separator 1, is at least 5 times the internal diameter DI of the separator 1. The chamber is defined between the inlet plane E and the top edge B of the swirl breaker 9. Furthermore, the ratio between the overall cross section F of the inlet conduits 5 and the square of the internal diameter DI of the separator 1, and thus of the separating chamber 10, is between 0.2 and 0.3, most preferably between 0.21 and 0.26. In this case, the overall cross section F is determined by the sum of the individual flow cross sections $f_1$ to $f_n$, where n=4 in the exemplary embodiment. Furthermore, the steam-side outlet conduit 2 expediently has an internal diameter DA which is between 40% and 60% of the internal diameter DI of the separating chamber 10. In respect of the overall cross section F [$m^2$] and of the internal diameter DI [m] of the separator 1 or separating chamber 10 and of the internal diameter DA [m] of the steam-side outlet conduit 2, the following dimensional relationships thus preferably apply:

$F=K\cdot DI^2$, where K=0.21 to 0.26

$DA=(0.5\pm0.1)\cdot DI$, and $A\geqq5\cdot DI$.

FIG. 2 shows a water/steam separating apparatus 11 of a continuous-flow steam generator, of which only the evaporator 12 and the superheater 13 are schematically illustrated. The water/steam separating apparatus 11 includes one or more separators 1 according to FIG. 1. Each separator 1 is connected to a water-collecting tank 15 on the water side via a connecting line 14 connected to the outlet conduit 3 of said separator. The introduction of the connecting line 14 from the separator 1 into the water-collecting tank 15 expediently takes place beneath the water level WS of the collecting tank 15. Placing the connecting line 14 beneath the water level WS ensures a calm water surface.

Within the water/steam separating apparatus 11, each separator 1 and the water-collecting tank 15 are preferably disposed in relation to one another such that the top end or top edge OK of the tank reaches at most halfway along the length L of the separator 1. In this case, the length L is measured between the top end OE and the bottom end UE of the separator 1. Halfway along the length (½ L) relates to the bottom end UE of the separator, and is thus measured from there.

During operation of the water/steam separating apparatus 11 of the continuous-flow steam generator, the water/steam mixture WD produced in the evaporator 12 of the generator flows, via the inlet conduits 5, into the separator 1. The water/steam mixture WD is also provided with a swirl there on account of the at least more or less tangential inflow. As a result of the centrifugal force thereby caused, water W and steam D are separated from one another. The separated steam D flows into the superheater 13 of the continuous-flow steam generator 13 via the steam-side outlet conduit 2 and a steamline 16 connected thereto. Simultaneously, the separated water W flows out into the water-collecting tank 15 via the swirl breaker 9 and the connecting line 14. In this case, the internal diameter DI of the separating chamber 10 and the throughput M [kg/s] through the separator 1 in relation to the full-load operation of the continuous-flow steam generator satisfying the following relationship:

$$M\geqq630\cdot DI^2.$$

Using a separator 1 within the water/steam separating apparatus 11 of the continuous-flow steam generator, it is possible to realize steam or live-steam pressures of 250 to 300 bar with a simultaneously low pressure loss and high medium throughput and particularly effective separation. Overall, in a steam power plant operated using such a separating apparatus 11, particularly high efficiency is achieved.

We claim:

1. A separator for separating water and steam, comprising:

a number of inlet conduits each having a flow cross section defining an overall flow cross section equaling a sum of said flow cross sections;

a separating chamber between said number of inlet conduits having a length, a separating chamber inner diameter, and a ratio equaling a ratio of said overall flow cross section to a square of said separating chamber internal diameter; said length being at least five times said separating chamber internal diameter; and said ratio being between 0.2 and 0.3;

a steam-side outlet conduit connected to said separating chamber;

a water-side outlet conduit connected to said separating chamber; and a swirl breaker disposed upstream of said water-side outlet conduit.

2. The separator according to claim 1, wherein said steam-side outlet conduit has a steam-side outlet conduit internal diameter equaling 40% to 60% of the separating channel internal diameter.

3. A water/steam separating apparatus comprising:

a separator for separating water and steam including:

a number of inlet conduits each having a flow cross section defining an overall flow cross section equaling a sum of said flow cross sections;

a separating chamber between said number of inlet conduits having a length with a midpoint, a separating chamber inner diameter, and a ratio equaling a ratio of said overall flow cross section to a square of said separating chamber internal diameter; said length being at least five times said separating chamber internal diameter; and said ratio being between 0.2 and 0.3;

a steam-side outlet conduit connected to said separating chamber;

a water-side outlet conduit connected to said separating chamber, said water-side outlet conduit being lower than said steam-side outlet conduit;

a swirl breaker disposed upstream of said water-side outlet conduit; and a water-collecting tank connected to said water-side outlet conduit of said separator, said water-collecting tank having a top end located beneath said midpoint of said length of said separator.

4. The water/steam separating apparatus according to claim 3, wherein said steam-side outlet conduit has a steam-side outlet conduit internal diameter equaling 40% to 60% of the separating channel internal diameter.

5. A method of operating a water/steam separating apparatus, which comprises:

providing a separator for separating water and steam including a number of inlet conduits each having a flow cross section defining an overall flow cross section equaling a sum of said flow cross sections, a separating chamber between said number of inlet conduits having a length with a midpoint, a separating chamber inner diameter, and a ratio equaling a ratio of said overall flow cross section to a square of said separating chamber internal diameter, said length being at least five times said separating chamber internal diameter, and said ratio being between 0.2 and 0.3, a steam-side outlet conduit connected to said separating chamber, a water-side outlet conduit connected to said separating chamber, said water-side outlet conduit being lower than said steam-side outlet conduit, and a swirl breaker disposed upstream of said water-side outlet conduit; and setting a throughput M through the separator at least equaling six hundred thirty times a square of the internal diameter.

6. The method according to claim 5, further comprises:

operating a continuous-flow steam generator including the separator at a maximum flow load.

7. The method according to claim 5, further comprises:

sizing a steam-side outlet conduit internal diameter of the steam-side outlet conduit between 40% and 60% of the separating channel internal diameter.

* * * * *